United States Patent [19]

O'Leary et al.

[11] 4,080,270

[45] Mar. 21, 1978

[54] PRODUCTION OF ALKALI METAL CARBONATES IN A MEMBRANE CELL

[75] Inventors: Kevin J. O'Leary, Cleveland Heights; Charles J. Hora, Jr., Willoughby Hills; Donald L. DeRespiris, Mentor, all of Ohio

[73] Assignee: Diamond Shamrock Corporation, Cleveland, Ohio

[21] Appl. No.: 707,215

[22] Filed: Jul. 21, 1976

Related U.S. Application Data

[63] Continuation-in-part of Ser. No. 542,967, Jan. 22, 1975, abandoned.

[51] Int. Cl.[2] ..... C25B 1/14

[52] U.S. Cl. ..... 204/87; 204/98; 204/180 P

[58] Field of Search ..... 204/87, 180 P, 98

[56] References Cited

U.S. PATENT DOCUMENTS

| | | | |
|---|---|---|---|
| 2,967,807 | 1/1961 | Osborne et al. | 204/87 |
| 3,179,579 | 4/1965 | Heinemann et al. | 204/87 |
| 3,220,941 | 11/1965 | Osborne | 204/87 |
| 3,374,164 | 3/1968 | Bales et al. | 204/265 |
| 3,793,163 | 2/1974 | Dotson | 204/98 |
| 3,897,320 | 7/1975 | Cook | 204/98 |
| 3,899,403 | 8/1975 | Cook et al. | 204/98 |
| 3,948,737 | 4/1976 | Cook et al. | 204/98 |
| 3,976,549 | 8/1976 | Falvo | 204/98 |

FOREIGN PATENT DOCUMENTS

| | | |
|---|---|---|
| 2,251,660 | 4/1973 | Germany. |
| 1,184,321 | 3/1970 | United Kingdom. |

*Primary Examiner*—T. Tung

*Attorney, Agent, or Firm*—Theodore J. Dettling

[57] ABSTRACT

An alkali metal carbonate substantially free of alkali metal chloride is efficiently produced by electrolyzing an alkali metal chloride in an electrolytic cell having anolyte and catholyte compartments separated by a cation-exchange hydraulically impermeable membrane comprised of a thin film of a fluorinated polymer having pendant sulfononate groups and a cathode spaced apart from the membrane, injecting into the catholyte compartment of the cell carbon dioxide in a quantity sufficient to convert substantially all of the alkali metal hydroxide forming therein to the alkali metal carbonate salt, and utilizing a magnitude of electrolyzing current that reduces alkali metal chloride in the carbonate salt to less than 400 ppm.

12 Claims, 3 Drawing Figures

PRODUCTION OF ALKALI METAL CARBONATES IN A MEMBRANE CELL

RELATED APPLICATIONS

This is a continuation-in-part of U.S. Ser. No. 542,967, filed Jan. 22, 1975, and now abandoned.

BACKGROUND OF THE INVENTION

This invention relates generally to a process for electrolytically producing an alkali metal carbonate. More particularly it relates to an improved process for electrolytically producing an alkali metal carbonate directly in a membrane cell employing particular permselective cation-exchange membranes and operating conditions.

It is known that alkali metal carbonate can be electrolytically produced directly from alkali metal chlorides in diaphragm and membrane cells by introducing carbon dioxide into the catholyte. However, processes presently known have deficiencies in one or more important particulars.

For example, U.S. Pat. No. 3,374,164 discloses that modern diaphragm cells, wherein the diaphragm is affixed to the cathode, while capable of operating at 95 to 95% electrolytic efficiency, only convert 60% of the alkali metal ions migrating through the diaphragm to the carbonate salt. Further, the patent discloses that even when the diaphragm is separated from the cathode and carbon dioxide is introduced into the resulting space, conversion efficiency can only be raised to 80% maximum. In either case, the carbonate salt is contaminated with unacceptable concentrations of chloride salt that must be removed by additional separate purification steps raising costs to noncompetitive levels.

U.S. Pat. No. 2,967,807, on the other hand, in Example III discloses that membrane cells of the prior art also produce carbonate salts having an appreciable level of chloride salt impurities. Additionally, the operating conditions specified in this Example, viz. 90 amperes/ft.$^2$ (0.62 amperes/in.$^2$) at an imposed voltage of 3.8–4.2, indicate that membrane cells require appreciably more energy and, thus, are considerably less efficient than diaphragm or mercury cells, and that they, therefore, would be unsuitable economically for the commercial production of alkali metal carbonate salts.

Because of these deficiencies, a significant quantity of high purity alkali metal carbonates, and especially potassium carbonate, is commercially made by carbonating alkali metal hydroxides produced from mercury cells. This, of course, involves the installation of auxiliary carbonation equipment and separate additional processing steps, both of which increase costs. However, the factor most militating against the use of mercury cells for the production of alkali metal carbonates is their potential to contaminate the environment. To minimize such contamination to acceptable levels, considerable monies must be spent for pollution control means and significantly higher operating costs are entailed.

In view of the foregoing, the industry has endeavored to develop processes that are capable of producing alkali metal carbonates having the purity of mercury cell products and at the same time the nonpolluting characteristics of the diaphragm and membrane cell processes. To date, this has not been achieved.

SUMMARY OF THE INVENTION

Considering this state of the art, it is an object of this invention to provide a process for the production of alkali metal carbonates having an order of purity of products derived from mercury cells without the need for the carbonation and pollution control equipment and procedures that characterize the mercury cell production of carbonates.

A further object is the provision of a process that permits the economical production of such alkali metal carbonates directly in an electrolytic cell.

These and still other objects, which will become apparent from the following description and claims, are achieved by electrolyzing an alkali metal chloride in an electrolytic cell having anolyte and catholyte compartments separated by a permselective, cation-exchange, hydraulically impermeable membrane of particular composition and properties, as described hereinafter, that is spaced apart from the cathode of the cell; injecting carbon dioxide into the catholyte compartment of the cell in a quantity sufficient to convert substantially all of the alkali metal hydroxide forming therein to alkali metal carbonate; utilizing an electrolyzing current density of sufficient magnitude to reduce the alkali metal chloride in the carbonate salt to less than 400 ppm; and removing the alkali metal carbonate from the catholyte compartment.

DESCRIPTION OF THE PREFERRED EMBODIMENTS

In the following description and claims, all parts are by weight, unless otherwise indicated.

Figure 1:
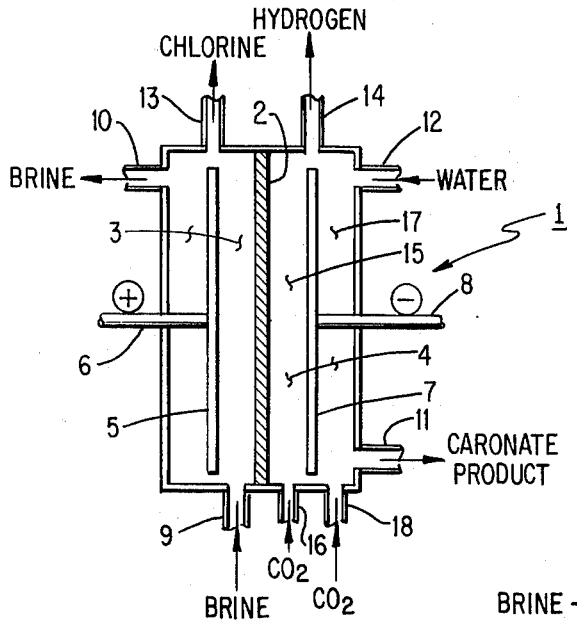
FIG. 1 is a side cross-sectional view of an electrolytic membrane cell that can be used to produce an alkali metal carbonate in accordance with the invention process.

In FIG. 1 there is illustrated a cell 1 separated by membrane 2 into an anode compartment 3 and a cathode compartment 4. In anode compartment 3, an anode 5 is shown mounted in a generally parallel, spaced-apart relationship to the membrane 2 and is connected to the positive terminal of an electrical supply source, not shown, by anode lead 6. Similarly, in cathode compartment 4 there is mounted a cathode 7 in a generally parallel, spaced-apart relationship to the membrane 2. The cathode 7 is connected to the negative terminal of an electrical supply source, not shown, by cathode lead 8.

Alkali metal chloride brine is charged to the anode compartment 3 through inlet 9 and depleted brine exits through outlet 10. Aqueous alkali metal carbonate product is removed from the cathode compartment 4 through outlet 11 while water, if required or desired to be added to the carbonate product, is charged through inlet 12. Chlorine and hydrogen gases are discharged through outlet vents 13 and 14 respectively. Carbon dioxide is injected into the cathode compartment 4 either into catholyte space 15 between the membrane 2 and the cathode 7 through inlet 16, or, alternatively, into catholyte space 17 behind the cathode 7 through inlet 18.

Figure 2:
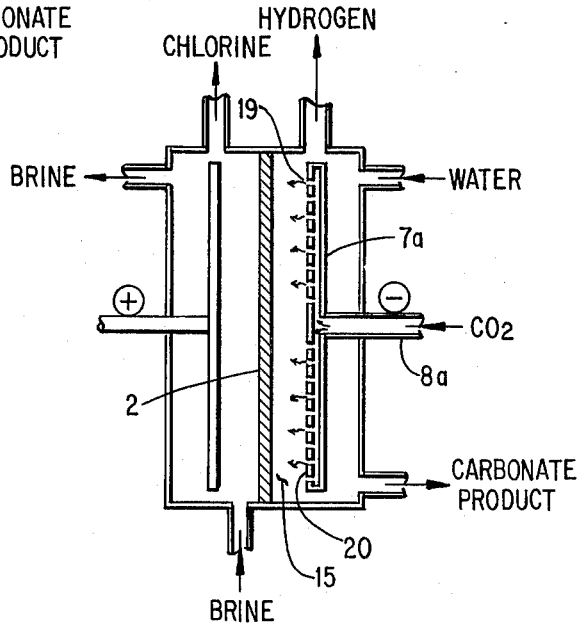
FIG. 2 is a similar view of a second cell configuration useful in the invention process having cathode means for introducing carbon dioxide into the catholyte.

The cell of FIG. 2 is identical to that of FIG. 1 except for the means of introducing carbon dioxide. In the cell illustrated in FIG. 2, the cathode lead 8a is a tube through which carbon dioxide is admitted and conveyed to a hollow cathode 7a having a multitude of apertures 19 in the side member 20 of the cathode 7a facing the membrane 2. As is apparent, with this cathode configuration carbon dioxide flows out through the apertures 19 into catholyte space 15 between the membrane 2 and the cathode 7a. Side member 20 may, for example, be a solid metal sheet or plate having multiple holes drilled therethrough to form the apertures 19, or it may be a sheet or plate of sintered metal particles having interstices forming the multiple apertures 19. Further, while FIG. 2 depicts the apertures 19 as being over essentially the whole area of side member 20, this is not mandatory since good results can be obtained when hollow cathode 7a has the plurality of apertures 19 disposed only in the lower portion of side member 20.

The anode 5 may be any conventional electrically conductive electrolytically-active material resistant to the anolyte such as graphite or, more preferrably, a valve metal such as titanium, tantalum or alloys thereof bearing on its surface a noble metal, a noble metal oxide (either alone or in combination with a valve metal oxide), or other electrolytically active, corrosion-resistant material. Anodes of this preferred class are called dimensionally stable anodes and are well known and widely used in industry. See, for example, U.S. Pat. Nos. 3,117,023; 3,632,498; 3,840,443; and 3,846,273. While solid anodes may be used, generally, foraminous anodes, such as expanded mesh sheet, are preferred since they have greater electrolytically-active surface areas and facilitate the formation, flow and removal of the chlorine gas in the anolyte compartment 3.

The cathode 7, similarily, may be any conventional electrically conductive material resistant to the catholyte such as iron, mild steel, stainless steel, nickel, and the like, and preferrably will be foraminous (screen, expanded mesh, apertured and the like) to facilitate the generation, flow and removal of hydrogen gas in the catholyte compartment 4. When, as described hereinafter, carbon dioxide is introduced through inlet 18 into the space 17 behind the cathode 7 and the cathode 7 is virtually coextensive with the cross-sectional area of the catholyte compartment 4, thus limiting or preventing catholyte flow, then the cathode 7 should be foraminous so that the carbon dioxide gas and/or alkali metal bicarbonate formed by reaction of the carbon dioxide with alkali metal carbonate can be carried by catholyte currents to the catholyte space 15 between the membrane 2 and the cathode 7.

The permselective, cation-exchange, hydraulically-impermeable membrane 2 consists essentially of a film of a fluorinated polymer having recurring structural units of the formula:

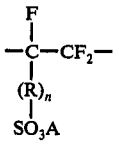

(I)

and

-continued $$-CXX'-CF_2- \quad \text{(II)}$$

usually made by reacting with aqueous sodium or potassium hydroxides (and then acidifying when A is H) a film of a precursor copolymer having structural units of II and

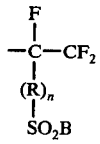

(III)

wherein R represents the group

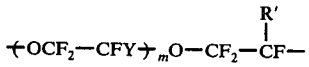

in which R′ is fluorine or perfluoralkyl of 1 to 10 carbon atoms, Y is fluorine or trifluoromethyl, and $m$ is 1, 2 or 3; $n$ is 0 or 1; A is H, Na or K; X is fluorine, chlorine, or trifluoromethyl; X′ is X or $CF_3$-$(CF_2)_z$- wherein $z$ is 0 or an integer from 1 to 5; and B is fluorine or chlorine. In the copolymer, the units of formula (I) should be present in an amount such that the copolymer has in the acid —$SO_3H$ form an equivalent weight of about 1000 to 1400, and the capability of absorbing at least about 15% by weight water (as determined on a film of the copolymer 1–10 mils in thickness immersed in 100° C water in accordance with ASTM D-570–63, paragraph 6.5). Especially preferred are membranes having a water absorption of about 25% or greater. Membranes having less water absorption require higher cell voltages at any given current density and are hence less power efficient. Similarly, membranes having a film thickness (unlaminated) of more than about 8 mils require higher voltages in the invention process and, thus, are similarily less preferred. Particularly preferred at this time are hydrolyzed copolymers of tetrafluorethylene and perfluoro (3,6,-dioxa-4-methyl-7-octenesulfonyl fluoride) having an equivalent weight of about 1100–1200.

Typically, because of the large surface areas of membranes present in commercial cells, the membrane film will be laminated to and impregnated into an hydraulically permeable, electrically non-conductive, inert, reinforcing member such as a woven or nonwoven fabric made from fibers of asbestos, glass, TEFLON and the like. In film/fabric composite membranes, it is preferred that the laminate have an unbroken surface of the film resin on both sides of the fabric to prevent leakage through the membrane caused by seepage along the fabric yarns. Such composites and methods for their manufacture are disclosed in U.S. Pat. No. 3,770,567. Alternatively, a film of the copolymer may be laminated to each side of the fabric. The thickness of the membrane "film" when this is done would be the sum of the two films' thicknesses.

The aforedescribed membranes are available from the E. I. DuPont de Nemours & Co. under the trademark NAFION. The preparation of and typical uses for the NAFION membranes are disclosed in U.S. Pat. Nos. 3,041,317, 3,282,875, and 3,624,053, British Pat. No. 1,184,321, German Provisional Publication No. 2,251,660 (corresponding to U.S. Ser. No. - 191,424 filed Oct. 21, 1971), and DuPont technical bulletin *XR PERFLUOROSULFONIC ACID MEMBRANES* published Oct. 1, 1969.

Lastly, the cation A in the $—SO_3A$ groups of the membrane will mostly be the same alkali metal as present in the chloride salt being electrolyzed to the carbonate salt. While the acid or other alkali metal salt form can be employed at start-up, it will be appreciated that the membrane will exchange virtually all of these cations for the cation of the salt being electrolyzed within a relatively short period of cell operation. Consequently, best practice dictates using a membrane having Na cations when NaCl is electrolyzed, and K cations for the electrolysis of KCl.

While the invention can be operated either as a batch or continuous process, as a practical matter it will normally be conducted on a continuous basis, and, hence, the following description of the invention operating parameters will be directed primarily to such a mode of operation, with the understanding that the same parameters and considerations generally apply to a batch process.

The invention process can be used to produce any alkali metal carbonate starting with the corresponding alkali metal chloride. Thus, sodium, potassium and lithium carbonates are made from sodium, potassium and lithium chlorides respectively. While mixtures of alkali metal carbonates can be electrolytically produced simultaneously in one cell, there is no demand for such mixtures and, therefore, the invention process is used primarily to produce each singularly.

As in the conventional electrolysis of alkali metal halides to form chlorine and alkali metal hydroxide and hydrogen, the alkali metal chloride is charged to the anode compartment to become the cell anolyte as an aqueous solution commonly referred to as "brine". The brine typically is acidified with an acid, such as hydrochloric acid, to a pH of about 3 or less to minimize oxygen evolution at the anode and to minimize the formation from any polyvalent cation impurities that might be present in the brine, such as $CA^{++}$ and $Mg^{++}$, of insoluble precipitates in the anolyte near the membrane surface.

Alternatively or in addition to the aforedescribed control of pH, the deleterious effect of polyvalent cation impurities can be minimized by adding to the brine a compound capable of forming at a pH of greater than 5.5 an insoluble gel with said polyvalent cations at the anolyte-membrane interface, said gel being reversible at a pH of less than 3.0, as disclosed in U.S. Pat. No. 3,793,163. Illustrative of such gel-forming compounds that can be used in the present invention are alkali metal phosphate, orthophosphate, and metaphosphate (preferably having the same alkali metal as the charged brine) or the free acid form of these phosphates. The use of such gel-forming compounds is especially efficacious, and hence preferred, when membrane films having a thickness of about 8 mils or less are employed since, it is believed, such gels may assist in reducing chloride impurities in the ultimate carbonate product.

Typically, in a preferred mode of operation, the brine is charged at or close to saturation in order to maximize the anolyte concentration and, hence, minimize the voltage requirements of the cell. Also affecting the anolyte concentration are the rate of charging the brine and the current density of the cell. More rapid brine-charging rates increase anolyte solids while higher cell current densities, conversely, more rapidly deplete anolyte solids. Ideally, these three interrelated parameters are chosen and controlled so that the anolyte at any given instant will have a solids concentration of about 75% or greater of saturation in order to minimize the voltage requirements of the cell. Anolyte concentrations of less than 75% of saturation, of course, are equally suitable when higher cell voltages are acceptable.

In the cathode compartment 4, electrolyte is charged at the startup of the process to provide initial catholyte. Typically, this electrolyte will have the same alkali metal as the brine and will be a carbonate salt to facilitate rapid equilibrium. After startup, the catholyte is continuously replenished during electrolysis by the alkali metal ion of the charged brine migrating through the membrane.

In the invention process, carbon dioxide gas is injected into the catholyte compartment in such a manner that it and/or the alkali metal bicarbonate formed by its reaction with the alkali metal carbonate reacts with the alkali metal hydroxide (formed from the alkali metal ions migrating through the membrane 2 and the hydroxyl ions generated at the cathode 7) primarily in the catholyte space 15 between the membrane 2 and the cathode 7. This is efficiently accomplished by directly injecting carbon dioxide into catholyte space 15 preferably at or near the bottom of cell. In the cell of FIG. 1 this can be achieved by introducing carbon dioxide into the cathode compartment 4 through inlet 16. Alternatively, the carbon dioxide can be introduced into the cathode compartment 4 through inlet 18 into catholyte space 17 where it and/or alkali metal bicarbonate formed by the reaction with alkali metal carbonate can be carried by catholyte currents (generated by hydrogen evolution and ebullition) around and through the cathode 7 (which, as previously described, normally will be foraminous) into the catholyte space 15. Lastly, both inlets 16 and 18 can be used to introduce the carbon dioxide into the catholyte. However, in some instances, introducing some or all of the carbon dioxide behind the cathode may be less preferred, as for example, when pure hydrogen gas is desired or when the cell has poor catholyte circulation. In the cell of FIG. 2 carbon dioxide, as previously explained, is introduced into catholyte space 15 via the plurality of aperatures 19 disposed in the surface member 20 of the hollow cathode **7*a* facing the membrane 2**. As is apparent, in all these various modes, carbon dioxide is preferrably added at or near the bottom of the cell to maximize its absorption and reaction in the catholyte.

The quantity of carbon dioxide injected into the catholyte compartment should be sufficient to give catholyte solids containing at least about 90% by weight of the desired carbonate salt if high current efficiencies, i.e. on the order of about 90% or greater, are to be attained. More preferred, however, is the use of carbon dioxide in quantities producing about 95% by weight or more of alkali metal carbonate in the catholyte solids, since current efficiencies are maximized in this range, generally exceeding 95%. For this reason, the stoichiometric quantity of carbon dioxide for producing essentially only carbonate salt is ideally and most preferably used. When less than stoichiometric is used, the carbonate product will contain minor amounts of the alkali metal hydroxide, while a stoichiometric excess results in carbonate product containing a minor quantity of the bicarbonate salt.

The carbon dioxide employed in the invention process may be essentially 100% pure or may be admixed with other gasses such as nitrogen and oxygen, as for example when flue gases resulting from the combustion of coal, gas, oil and the like are used as the source of the carbon dioxide. However, flue-gas carbon dioxide will not normally be used when high-purity by-product hydrogen gas is desired.

The width of the catholyte space 15 between the membrane 2 and the cathode 7, ideally is that distance which minimizes the cell voltage required to establish and maintain the desired cell current density. Generally, at any given set of cell operating conditions, cell voltage will vary with this distance, with the optimum distance being primarily dependent on cell current density, and secondarily on the purity of the carbon dioxide employed. Because of the gas blanketing effect on the cathode 7 caused by hydrogen evolution and ebullition and further considering the possible presence of carbon dioxide gas in catholyte space 15, both of which increase with higher current densities, the width of the catholyte space 15 often, depending upon cathode design, must be increased as the density of the electrolyzing current is raised if minimum cell voltages are to be realized. When carbon dioxide containing other gases, such as flue gas, is employed, usually the distance also must be increased to compensate for the gas blanketing effect contributed by these other gases. Still another factor affecting this optimum distance is the cell configuration, particularily when the carbon dioxide is introduced between the membrane and cathode primarily near the bottom of the cell. Cells having high height-to-width ratios generally require greater distances. From a practical standpoint, bearing in mind all these interrelated factors, the distance between the membrane 2 and the cathode 7 in the catholyte space 15 should be chosen so that the operating voltage of the cell will not exceed by more than about 10% the minimum voltage observed when the optimum distance is employed. Widths of cathode space 15 meeting this criteria typically will be about 0.10 to 1.0 inch for cell current densities in the range of 1 to 5 amperes per square inch.

With respect to the spacing of the anode 5 from the membrane 2, this distance ideally is the minimum that maintains high current efficiency with respect to chlorine generation, and minimizes the cell voltage. Usually, depending on cell and anode design and characteristics, minimum voltage and excellent chlorine current efficiency are achieved when the anode is contiguous to and touching the membrane. Sometimes though, a small spacing, such as about 0.05–0.20 inch, will be optimum.

Normally, the concentration of catholyte solids consisting of carbonate salt, plus any by-product hydroxide or bicarbonate present, will be that naturally occurring under the conditions of cell operation utilized, and idealy will be about 75 to 100% of saturation so as to minimize voltage requirements and the cost of removing water from the final carbonate product. When necessary to prevent precipitation of the carbonate salt, external water may be added to the catholyte. This is usually required when the alkali metal carbonates are produced from anolyte brines having concentrations at or near their saturation points.

The temperatures of the anolyte and catholyte in the invention process are not especially critical with respect to achieving high current efficiency. However, because voltage diminishes as the temperature increases, temperatures of about 90° C. or more are preferrably utilized when it is desired to minimize the power consumed per unit of carbonate salt product.

Similarily, the hydrostatic pressure of the anolyte and catholyte is not particularily critical with respect to obtaining high current efficiency. As a practical matter though, a net positive pressure will normally be maintained on the catholyte side to ensure the required cathode-membrane spacing, and particularily when the cell is operated with the anode and membrane in the contiguous and touching configuration.

In the invention process, a magnitude of current density in excess of one ampere per square inch (asi) is utilized that reduces the alkali metal chloride level in the catholyte solids to less than 400 parts per million (ppm). Surprisingly, it has been discovered that for any particular aforedescribed membrane utilized in the invention process, the level of chloride salt impurity decreases as the magnitude of the current density increases. The magnitude of current density required to achieve this low level of salt impurity will vary depending upon the thickness and equivalent weight of the membrane utilized. As can be seen from the examples hereinafter, very thin membranes, as for example 3.5 mils thick, having equivalent weights of 1100 or less generally require about 3 or more amperes of current per square inch of membrane area to reduce the chloride salt to the desired level of less than 400 parts per million parts of catholyte solids. Five-mil membranes of the same equivalent weight and seven-mil membrane of about 1200 equivalent weight, on the other hand, usually achieve levels below 400 ppm in the 1.5–2.0 asi range of current densities. While exact limits cannot be precisely delineated, current densities suitable for any particular membrane and degree of product purity can be readily ascertained from the foregoing considerations and the data hereinafter provided.

The catholyte is typically discharged from the cathode compartment at a rate proportional to the rate of transport of the hydrated alkali metal ions through the membrane (proportional to current density) and the rate of any external water added to the catholyte so as to maintain an essentially constant catholyte volume. After being discharged, the catholyte typically is transported to a holding tank prior to further processing such as concentrating, drying or packaging for shipment. At this point any residual by-product hydroxide or bicarbonate can be chemically removed if deemed undesirable in the final product. Residual alkali metal hydroxide is simply removed by adding either carbon dioxide or a bicarbonate salt (of the same alkali metal as the carbonate product) in a quantity sufficient to convert the by-product hydroxide present to the carbonate salt. Residual bicarbonate salt, on the other hand, can be removed by one or combination of the following two means. If the carbonate product is concentrated or dried, the first means consists of employing temperatures sufficiently high for a period adequate to decompose the residual bicarbonate to the carbonate salt. Alternatively, the residual alkali metal bicarbonate in the discharged catholyte is reacted with a stoichiometric quantity of a hydroxide of the same alkali metal.

Alkali metal carbonates, and particularly the sodium and potassium carbonates, are well known large volume industrial chemicals. Like the products of the prior art, the alkali metal carbonate produced by the invention process can be marketed either as liquors or as anhydrous or hydrated solid materials and are produced from the discharged catholyte by means conventional to the industry such as concentrating, drying and the like. Similarly, they can be used for like end uses such as: in the manufacture of glass, alumina, paper and detergents; as the precursor of other alkali metal compounds; and as regenerable absorbents for carbon dioxide and hydrogen sulfide. As can be appreciated, many industrial applications do not require alkali metal carbonates of absolute purity with respect to alkali metal hydroxide or bicarbonate and, hence, can employ carbonate products made by the invention process containing minor amounts (e.g. 3%) of these by-products.

While the preceding description and following examples are directed, for clarity, to single cells, it will be obvious that in commercial operation a plurality of such cells will usually be combined in a single electrolyzing unit either in a series arrangement using bipolar electrodes or in a parallel configuration using monopolar electrodes.

EXAMPLES

Figure 3:
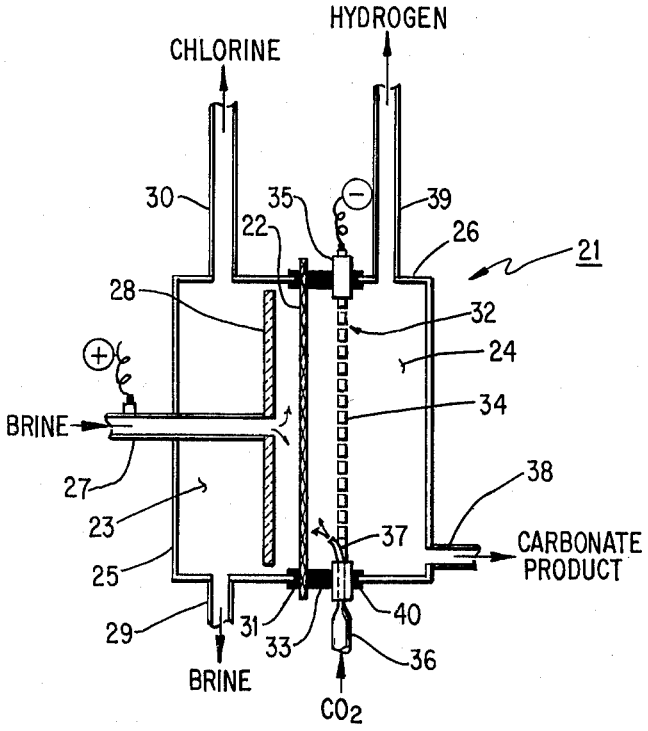
FIG. 3 is a side cross-sectional view of a cell used in the examples.

An electrolytic cell like that shown in FIG. 3 was used for Examples 1–20 compiled in Tables 1 and 2. The cell used, generally designated 21, was divided by a membrane 22 into an anode compartment 23 and a cathode compartment 24 formed by glass cylindrical half-cell members 25 and 26 respectively having front-to-back depths of four inches and inside diameters of two inches.

In the anode compartment 23, there was provided a brine inlet tube 27 made of titanium metal to which there was welded a circular anode 28 disposed essentially parallel to the membrane 22. The anode 28 had a diameter of about 1.95 inches and was made from an expanded mesh of titanium metal bearing a $2TiO_2$:$RuO_2$ mole ratio coating. Depleted brine was discharged through outlet 29 while chlorine gas was vented off through anolyte standpipe 30, which in examples 1–20 was filled with anolyte to a height of 11½ inches measured from the bottom of the cell. Total volume of anolyte in the anode compartment 23 and the standpipe 30 was about 335 cubic centimeters. To insure a good seal, gasket 31 having an inside diameter of about 1.95 inches was positioned between half-cell member 25 and the membrane 22.

In the cathode compartment 24, a cathode assembly 32 was positioned in a generally parallel spaced-apart relationship from the membrane 22 by a gasket 33 having an inside diameter of 1.95 inches. The cathode assembly 32 consisted of an apertured stainless steel plate 34 circumscribed by a holding flange 35. Passing through the holding flange 35 at the bottom of the cell 21 was a carbon dioxide inlet 36 having exit ports 37 directing the carbon dioxide gas generally both upwardly and sidewardly towards the membrane 22. Catholyte containing carbonate product was discharged through outlet 38 while by-product hydrogen gas was vented off through a catholyte standpipe 39, which in examples 1–20 was filled with catholyte to a height of 9 inches measured from the bottom of the cell. When water was added to the catholyte in some of the examples, it was charged to the catholyte standpipe 39. Total volume of catholyte in the cathode compartment 24 and the standpipe 39 was about 195 cubic centimeters. Finally, gasket 40 was used between the holding flange 35 and half-cell member 26 to ensure a hydraulically impermeable seal between these two cell components.

Examples 21–26 compiled in Table 3 utilized the same cell shown in FIG. 3 with the following modifications: carbon dioxide was injected into the cathode compartment through an inlet located 2 inches from the membrane behind the cathode and at the bottom of the cell; the depth of anolyte in the anolyte standpipe 30 from the bottom of the cell was 12 inches while the depth of the catholyte in the catholyte standpipe 39 from the bottom of the cell was 5½ inches; spent brine and catholyte product were discharged through the anolyte standpipe 30 and catholyte standpipe 39 respectively; the anode 28 was positioned contiguous to and touching the membrane 22; and the cathode 34 was positioned 0.375 inches from the membrane 22.

Finally, Examples 27–30 compiled in Table 4 utilized a pilot cell, 5 inches wide and 20 inches high having a membrane area of 100 square inches, an anode-membrane spacing of 0.125 inches, a cathode-membrane spacing 0.031 inches, a net catholyte pressure of about 0.14 psi., and a carbon dioxide inlet located one inch from the membrane behind the cathode near the bottom center of the cell.

In all the examples the membrane used consisted of a film of a copolymer of tetrafluorethylene and perfluoro [2-(2-fluorosulfonylethoxy)-propyl vinyl ether] that was first laminated to a T-12 (Teflon square-woven) fabric and then hydrolyzed and acidified to convert the sulfonyl fluoride groups of the copolymer to sulfonic acid groups. For the examples of Table 1 the film used had a thickness of 7 mil and was made from a copolymer having, after hydrolysis and acidification, an $—SO_3H$ equivalent weight of about 1200 and a water absorption at 100° C of about 25% by weight. The examples of Table 2 and 3, on the other hand, employed a film of 3.5 mils thickness made from a copolymer having an equivalent weight of about 1100 and a water absorption at 100° C of about 38% by weight. Lastly, the Table 4 examples utilized a 5 mil film having an 1100 equivalent weight.

In all the examples, except where otherwise noted, there was used a current density of about 2 amperes per square inch (asi) of membrane area exposed to the electrolytes. The brines used in Examples 1–20 contained 0.26 cubic centimeter of 85% $H_3PO_4$ per liter and were acidified with HCl to a pH of about 2.0. The other cell operating parameters employed for the examples were as shown in the tables. The data for Examples 1–26 were taken after the cell had been operating for at least 18 hours in the specified mode to ensure essentially equilibrium conditions. For examples 27–30, using the larger cell, at least 72 hours was used before taking data.

Table 1

Production of $K_2CO_3$ in 7 Mil Membrane Cell[1]

| Example | Days After Startup | $CO_2$ Feed Rate[2] (cc/min.) | Brine Feed Rate (cc/min.) | Temperature (° C) Anolyte | Temperature (° C) Catholyte | Cell Voltage | Catholyte Solids (g/l) | KOH (%)[3] | $K_2CO_3$ (%)[3] | $KHCO_3$ (%)[3] | KCl[4] (ppm) | Current[5] Efficiency (%) |
|---|---|---|---|---|---|---|---|---|---|---|---|---|
| 1 | 9 | 55 | 5.4 | 79 | — | 5.75 | 545 | 0 | 89.7 | 10.3 | — | 94.4 |
| 2 | 15 | 85 | 4.0 | 78 | — | 5.35 | 560 | 0 | 90.3 | 9.7 | 653[6] | 94.3 |
| 3 | 17 | 90 | 1.9 | 84 | — | 4.95 | 525 | 0 | 85.0 | 15.0 | — | 91.6 |

Table 1-continued

| Example | Days After Startup | $CO_2$ Feed Rate[2] (cc/min.) | Brine Feed Rate (cc/min.) | Temperature (° C) Anolyte | Temperature (° C) Catholyte | Cell Voltage | Catholyte Solids (g/l) | KOH (%)[3] | $K_2CO_3$ (%)[3] | $KHCO_3$ (%)[3] | KCl[4] (ppm) | Current[5] Efficiency (%) |
|---|---|---|---|---|---|---|---|---|---|---|---|---|
| | | | | Production of $K_2CO_3$ in 7 Mil Membrane Cell[1] | | | | | | | | |
| 4 | 18 | 75 | 1.7 | 85 | — | 4.95 | 533 | 0 | 91.0 | 9.0 | 356 | 95.3 |
| 5 | 25 | 50 | 5.4 | 75 | 64 | 5.35 | 555 | 0 | 96.4 | 3.6 | — | 94.8 |
| 6 | 30 | 35 | 1.3 | 87 | 72 | 5.10 | 523 | 1.9 | 98.1 | 0 | 2 | 99.2 |
| 7 | 32 | 30 | 5.4 | 84 | 71 | — | 524 | 2.5 | 97.5 | 0 | — | 97.7 |
| 8 | 37 | 20 | 2.7 | 89 | 74 | — | 497 | 16.1 | 83.9 | 0 | — | 85.1 |
| 9 | 40 | 0 | 10.0 | 88 | 70 | — | 415 | 100 | 0 | 0 | 48 | 58.7 |
| 10 | 49 | 40 | 6.3 | 75 | 67 | 4.87 | 498 | 1.6 | 98.4 | 0 | 24 | 95.5 |

[1]Constant Cell Operating Parameters
a) Brine - aqueous KCl (225 grams per liter)
b) Anode/Membrane Spacing - 0.25 inch
c) Cathode/Membrane Spacing - 0.125 inch
d) $H_2O$ Feed Rate to Catholyte - 12.4 cc/hr.
[2]Stoichiometric quantity of $CO_2$ required at 6 amperes current to produce only $K_2CO_3$is theoretically 41.8 cc STP/min.
[3]Percent by weight in catholyte solids.
[4]Parts per million of KCl in catholyte solids.
[5]Total current efficiency for $K_2CO_3$ and KOH or $KHCO_3$.
[6]KCl in catholyte determined 16 days after startup of cell.

Table 2

| Example | Days After Startup | $CO_2$ Feed Rate[2] (cc/min.) | $H_2O$ Feed Rate (cc/min.) | Temperature (° C) Anolyte | Temperature (° C) Catholyte | Cell Voltage | Catholyte Solids (g/1) | KOH (%)[3] | $K_2CO_3$ (%)[3] | $KHCO_3$ (%)[3] | KCl[4] (ppm) | Current[5] Efficiency (%) |
|---|---|---|---|---|---|---|---|---|---|---|---|---|
| | | | | Production of $K_2CO_3$ in 3.5 Mil Membrane Cell[1] | | | | | | | | |
| 11 | 4 | 50 | 12.4 | — | 84 | 3.53 | 569 | 0 | 89.9 | 10.1 | — | 93.6 |
| 12 | 5 | 50 | 12.4 | — | 85 | 3.62 | 548 | 0 | 95.4 | 4.6 | 255 | 92.5 |
| 13 | 11 | 50 | 8.7 | — | — | 3.87 | 577 | 0 | 98.8 | 1.2 | — | 94.8 |
| 14 | 12 | 50 | 8.7 | — | — | 3.87 | 589 | 0 | 97.4 | 2.6 | 680 | 96.0 |
| 15 | 16 | 50 | 0 | — | 79 | 4.10 | 758 | 1.7 | 98.3 | 0 | — | 95.5 |
| 16 | 18 | 50 | 0 | — | 83 | 4.10 | 767 | 0.7 | 99.3 | 0 | — | 93.9 |
| 17 | 20 | 50 | 0 | — | 90 | 4.03 | 788 | 1.4 | 98.6 | 0 | 254 | 99.3 |
| 18 | 37 | 70 | 10.5 | 82 | 84 | 4.75 | 573 | 0.5 | 99.5 | 0 | 698 | 96.6 |
| 19 | 46 | 90 | 10.5 | 74 | 83 | 5.82 | 662 | 0.8 | 99.2 | 0 | 151 | 96.5 |
| 20 | 50 | 110 | 10.5 | 94 | 103 | 6.67 | 771 | 2.2 | 97.8 | 0 | N.D.[6] | 97.1 |

[1]Constant Cell Operating Parameters
a) Brine - aqueous KCl (225 grams per liter)
b) Brine Feed Rate to Anolyte - 4cc/min.
c) Anode/Membrane Spacing - .0625 inch
d) Cathode/Membrane Spacing - .0938 inche) In example 18 a current density of 3 ASI and a brine feed rate of 6.1 cc/min. was used.
f) In example 19 a current density of 4 ASI and a brine feed rate of 10.7 cc/min. was used.
g) In example 20 a current density of 5 ASI and a brine feed rate of 11.0 cc/min. was used.
[2]Stoichiometric quantity of $CO_2$ required to produce only $K_2CO_3$ is theoretically 6.964 cc STP/min. for each ampere of current.
[3]Percent by weight in catholyte solids.
[4]Parts per million of KCl in catholyte solids.
[5]Total current efficiency for $K_2CO_3$ and KOH or $KHCO_3$.
[6]KCl was not detectable.

Table 3

| Ex. | Days After Startup | Current Density (asi) | $CO_2$ Feed Rate[1] (cc/min) | Brine[2] Feed Rate (cc/min) | $H_2O$ Feed Rate (cc/hr) | Cell[3] Voltage | Catholyte Solids (g/l) | KOH (%)[4] | $K_2CO_3$ (%)[4] | $KHCO_3$ (%)[4] | KCl[5] (ppm) | Current[6] Efficiency (%) |
|---|---|---|---|---|---|---|---|---|---|---|---|---|
| | | | | Production of $K_2CO_3$ in 3.5 Mill Membrane Cell with $CO_2$ Injection Behind the Cathode | | | | | | | | |
| 21 | 67 | 0.5 | 11.25 | 4–6 | 10.5 | 2.97 | 264 | — | 91.4 | 8.6 | 39,200 | 96.0 |
| 22 | 71 | 0.62 | 11.25[7] | 4–6 | 9.3 | 2.99 | 293 | 5.3 | 94.7 | — | 33,600 | 96.3 |
| 23 | 63 | 1 | 22.5[7] | 4–6 | 14.8 | 3.26 | 314 | 14.3 | 85.7 | — | 9,180 | 89.4 |
| 24 | 57 | 2 | 45 | 4–6 | 17.7 | 3.86 | 410 | 1.4 | 98.6 | — | 1,670 | 97.6 |
| 25 | 60 | 3.85 | 90 | 8–12 | 15.9 | 6.50 | 489 | 1.7 | 98.3 | — | 61 | 97.9 |
| 26 | 61 | 3.85 | 90 | 8–12 | 15.5 | 6.61 | 466 | 3.6 | 96.4 | — | 150 | 95.0 |

[1]Volume of $CO_2$ at ambient conditions. Stoichiometric quantity of $CO_2$ required to produce only $K_2CO_3$ is theoretically 6.964 cc STP/min for each ampere of current. Effective membrane area was 3 sq. in.
[2]Brine used was aqueous KCl (205–218 grams per liter) having a pH of 1.8–2.3 and 326–427 ppm of phosphate ions.
[3]In all the examples, anolyte was maintained at 90° C while catholyte varied from about 68° C at 0.5 asi to about 88° C at 3.85 asi.
[4]Percent by weight in catholyte solids.
[5]Parts per million of KCl in catholyte solids.
[6]Total current efficiency for $K_2CO_3$ and KOH or $KHCO_3$.
[7]$CO_2$ port either partially or totally blocked during part of the test period.

Table 4

| Example | Days After Startup | Current Density (asi) | Cell Voltage | Catholyte Solids (g/1) | KOH (%)[2] | $K_2CO_3$ (%)[2] | KCl (ppm)[3] | Current Efficiency (%)[4] |
|---|---|---|---|---|---|---|---|---|
| | | | | Production of $K_2CO_3$ in a 100 Square Inch Membrane Cell[1] | | | | |
| 27 | 17 | 0.62 | 3.10 | 616 | 1.8 | 98.2 | 1,945 | 98.7 |
| 28 | 10 | 0.98 | 3.57 | 633 | 4.0 | 96.0 | 631 | 99.5 |
| 29 | 5 | 1.87 | 4.24 | 575 | 4.4 | 95.6 | 174 | 99.6 |

Table 4-continued

| Production of $K_2CO_3$ in a 100 Square Inch Membrane Cell[1] | | | | | | | | |
|---|---|---|---|---|---|---|---|---|
| Example | Days After Startup | Current Density (asi) | Cell Voltage | Catholyte Solids (g/l) | KOH (%)[2] | $K_2CO_3$ (%)[2] | KCl (ppm)[3] | Current Efficiency (%)[4] |
| 30 | 20 | 1.91 | 4.34 | 587 | 7.6 | 92.4 | 170 | 101.7 |

[1]Brine used was aqueous KCl (about 310 g/l) having a pH of 1.5–3.0 and about 400 ppm of phosphate ions. Anolyte temperature was about 90° C in all examples, while catholyte varied from 85° C at 0.62 asi to 93° C at 1.91 asi.
[2]Percent by weight in catholyte solids.
[3]Parts per million of KCl in catholyte solids.
[4]Total current efficiency for $K_2CO_3$ and KOH.

The examples show that high current efficiencies are obtained when carbon dioxide is introduced at a rate close to stoichiometric for the production of carbonate, i.e. at a rate producing in the catholyte solids about 90 weight percent or more of the carbonate salt and about 10 weight percent or less of either the hydroxide or bicarbonate; and that maximum efficiencies are obtained when carbon dioxide is exactly or just slightly less or more than stoichiometric, i.e. when the catholyte solids contains no more than about 3 weight percent hydroxide or bicarbonate. Noteworthy is the surprising decline of chloride salt in the catholyte solids with increasing current densities; and the ability of even 3.5 and 5 mil membranes to limit chloride contamination to commercially acceptable levels at about 4 and 2 ASI respectively. Further, it is apparent that the use of the thinner membranes effects a significant reduction in cell voltages without compromising current efficiencies or the ability of the process to produce high-purity commercial-grade carbonate product when a sufficiently high current density is used. Additionally worthy of note is the high concentration of alkali metal carbonate (nearly saturated) produced in Examples 14–16 and 20, which would minimize the energy required for further concentrating or drying of the discharged catholyte to the final products of commerce. Finally, it was observed that voltages increased only slightly upon prolonged running of the cells and seemed to reach a steady state after a few days of continuous cell operation.

From the foregoing description and examples, it will be apparent to those skilled in the art that the process of the present invention is capable of producing alkali metal carbonate of high purity having virtually no contaminating alkali metal chloride at current efficiencies of 95% and greater. Further, it will be apparent that the invention process achieves this at a level of energy consumption comparable to commercial diaphragm and mercury cell operations and is an economically viable alternative for such processes. Additionally noteworthy are the findings that the process can be run at high current densities (e.g. 2 asi or more) for long periods without membrane degradation and with no significant increase in cell voltage requirements upon prolonged operation, and is capable of directly producing alkali metal carbonate liquors at or near saturation, thus minimizing the energy required for concentrating or drying to produce products of commerce.

In view of these characteristics and advantages of the invention process, it can be seen that applicants have provided a viable new method for producing alkali metal carbonates that has the desirable attributes of both the mercury and diaphragm cell processes without their inherent disadvantages and shortcomings — a goal that has been long sought but never attained by the industry.

The embodiments of the invention in which an exclusive property or privilege is claimed are defined as follows:

1. In a method for producing an alkali metal carbonate wherein:

A. an alkali metal chloride is electrolyzed in an electrolytic cell having an anode and cathode in anolyte and catholyte compartments separated by a permselective cation-exchange membrane that is impervious to hydraulic flow and is spaced apart from the cathode;

B. carbon dioxide is injected into the catholyte compartment to give catholyte solids wherein substantially all of the alkali metal hydroxide formed therein is converted to alkali metal carbonate; and C. catholyte containing the alkali metal carbonate is removed from the catholyte compartment; the improvement which comprises:

D. utilizing a membrane which:

1. consists essentially of a film having a thickness not exceeding 8 mils of a copolymer having recurring structural units of the formula:

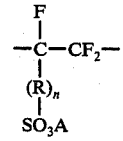

(I)

and $$-CXX'-CF_2- \quad \text{(II)}$$

wherein R represents the group

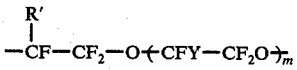

in which R′ is fluorine or perfluoralkyl of 1 to 10 carbon atoms, Y is fluorine or trifluoromethyl, and $m$ is 1, 2 or 3; $n$ is 0 or 1; A is H, Na, or K; X is fluorine, chlorine, or trifluoromethyl; and X′ is X or $CF_3-(CF_2)_z$ wherein $z$ is 0 or an integer from 1 to 5; the units of formula (I) being present in an amount to provide a copolymer having in the acid form an $-SO_3H$ equivalent weight of about 1000 to 1400; and 2. is capable when immersed in 100° C water of absorbing at least 15% by weight water; and E. utilizing an electrolyzing current density in excess of one ampere per square inch of membrane area of sufficient magnitude to reduce alkali metal chloride in the catholyte solids to less than 400 parts per million.

2. The method of claim 1 wherein the electrolyzing current density utilized is of sufficient magnitude to reduce the alkali metal chloride impurity in the catholyte solids to less than 200 parts per million.

3. The method of claim 1 wherein the membrane copolymer film has a thickness not exceeding about 5 mils.

4. The method of claim 3 wherein the electrolyzing current density utilized is of sufficient magnitude to reduce the alkali metal chloride impurity in the catholyte solids to less than 200 parts per million.

5. The method of claim 1 wherein the membrane film consists essentially of a copolymer having recurring structural units of the formula:

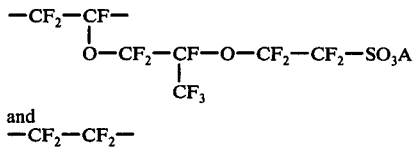

and has an $—SO_3H$ equivalent weight of about 1050 to 1250.

6. The method of claim 5 wherein the electrolyzing current density utilized is of sufficient magnitude to reduce the alkali metal chloride impurity in the catholyte solids to less than 200 parts per million.

7. The method of claim 5 wherein the membrane copolymer film has a thickness not exceeding about 5 mils.

8. The method of claim 7 wherein the electrolyzing current density utilized is of sufficient magnitude to reduce the alkali metal chloride impurity in the catholyte solids to less than 200 parts per million.

9. The method of claim 5 wherein the alkali metal chloride electrolyzed is potassium chloride and A is potassium.

10. The method of claim 5 wherein the alkali metal chloride electrolyzed is sodium chloride and A is sodium.

11. The method of claim 1 wherein the alkali metal chloride electrolyzed is potassium chloride and A is potassium.

12. The method of claim 1 wherein the alkali metal chloride electrolyzed is sodium chloride and A is sodium.

* * * * *